US008411121B2

(12) United States Patent
Yamamoto

(10) Patent No.: US 8,411,121 B2
(45) Date of Patent: Apr. 2, 2013

(54) THERMAL PRINTHEAD WITH OPTIMALLY SHAPED RESISTOR LAYER

(75) Inventor: Tadashi Yamamoto, San Diego, CA (US)

(73) Assignee: Rohm Semiconductor USA, LLC, San Diego, CA (US)

( * ) Notice: Subject to any disclaimer, the term of this patent is extended or adjusted under 35 U.S.C. 154(b) by 76 days.

(21) Appl. No.: 13/160,503

(22) Filed: Jun. 14, 2011

(65) Prior Publication Data

US 2012/0320139 A1 Dec. 20, 2012

(51) Int. Cl.
*B41J 2/335* (2006.01)

(52) U.S. Cl. ..... 347/208

(58) Field of Classification Search ..... 347/200, 347/201–203, 204–208
See application file for complete search history.

(56) References Cited

U.S. PATENT DOCUMENTS

| | | | | |
|---|---|---|---|---|
| 3,931,492 | A | 1/1976 | Takano et al. | |
| 4,262,188 | A | 4/1981 | Beach | |
| 4,797,837 | A | 1/1989 | Brooks | |
| 4,819,011 | A | 4/1989 | Yokota | |
| 5,483,274 | A | 1/1996 | Inoue et al. | |
| 5,491,505 | A | 2/1996 | Suzuki et al. | |
| 5,517,224 | A | 5/1996 | Kaizu et al. | |
| 5,567,630 | A | 10/1996 | Matsumoto et al. | |
| 5,677,721 | A | 10/1997 | Suzuki et al. | |
| 5,714,994 | A | 2/1998 | Suzuki et al. | |
| 6,229,557 | B1 * | 5/2001 | Ooyama | 347/200 |
| 6,664,992 | B1 * | 12/2003 | Yokoyama et al. | 347/208 |
| 7,990,405 | B2 * | 8/2011 | Fukumoto | 347/202 |
| 2001/0001558 | A1 | 5/2001 | Ishinaga et al. | |
| 2005/0270359 | A1 | 12/2005 | Katsuma et al. | |
| 2008/0211840 | A1 | 9/2008 | Zevin et al. | |

FOREIGN PATENT DOCUMENTS

| | | | | |
|---|---|---|---|---|
| JP | 403073364 | * | 3/1991 | 347/200 |
| JP | 404126261 | * | 4/1992 | 347/208 |
| JP | 2000-025253 | A | 1/2000 | |
| JP | 2001-232830 | A | 8/2001 | |
| JP | 2001-270140 | A | 10/2001 | |
| JP | 2004-142356 | A | 5/2004 | |
| JP | 2007-144890 | A | 6/2007 | |
| JP | 2007-331357 | A | 12/2007 | |

OTHER PUBLICATIONS

Applicant brings the attention of the Examiner to the following pending U.S. Appl. No. 13/160,494, filed Jun. 14, 2011 and U.S. Appl. No. 13/160,499, filed Jun. 14, 2011.

* cited by examiner

*Primary Examiner* — Kristal Feggins
(74) *Attorney, Agent, or Firm* — Chen Yoshimura LLP

(57) ABSTRACT

A thermal printhead having an optimal resistor element shape which is capable of high speed and high quality printing is provided. The thermal printhead for progressively printing a pattern of dots on a thermosensitive paper moving in one direction, includes a substrate, and a plurality of resister elements on the substrate arranged in a substantially straight line extending in a direction perpendicular to a moving direction of the thermosensitive paper, the plurality of resistor elements each corresponding to respective one of the dots constituting the pattern to be printed onto the thermosensitive paper, each of the resistor elements having a heat transfer area that will be in contact with the thermosensitive paper upon printing the dot, wherein at least one of two sides of the heat transfer area that are substantially perpendicular to the moving direction of the thermosensitive paper has a sag in a substantially middle portion thereof to adjust a shape of the dot.

13 Claims, 14 Drawing Sheets

THERMAL PRINTHEAD WITH OPTIMALLY SHAPED RESISTOR LAYER

BACKGROUND OF THE INVENTION

1. Field of the Invention

The present invention relates to a thermal printhead, and more particularly, to a thermal printhead having an optimally shaped resistor layer.

2. Description of the Related Art

Thermal printing techniques have been widely used in such areas as portable/mobile, retail, gaming/lottery, and medical due to several advantages over other types of printing techniques such as inkjet, laser or ribbon. Some examples of the advantages are quiet operation, light weight due to a simple structure, no need for ink, toner, or ribbon to replace, and the like. With these advantages, thermal printers based on the thermal printing techniques are used in a variety of devices under a wide range of environments. In particular, thermal printers are likely to be subjected to a wider range of temperatures compared with other types of printers which are mainly used in offices or in a house. As thermal printers rely on heat to print images onto a thermosensitive paper, there is a need for a thermal printhead used in a thermal printer that can offer a reliable fast printing without deterioration of the printing quality even in an extreme ambient temperature.

FIG. 1 shows a simplified cross-sectional view of a conventional thermal printhead B1. The thermal printhead B1 includes a substrate 101, a resistor layer 102, a heatsink 105, a drive IC 106 and a platen 120. In printing an image using the thermal printhead B1, a portion of the resistor layer 102 which constitutes a heating element to imprint a dot is heated by supplying electrical power. When a series of dots is to be printed, this particular portion of the resistor layer 102 is repeatedly supplied with electrical power with power on times in between power off times and the series of dots is printed onto a thermosensitive paper 121 during the power on times. If the series of dots is a long one, the temperature buildup of the resistive layer 102 may occur. Particularly, when On/Off switching speed of supplying electrical power is increased, it may become difficult for the resistive layer 102 to follow the increased switching speed because the resistor layer 102 cannot dissipate the heat fast enough due to the temperature buildup.

In contrast to forced heating of the particular portion of the resistor layer 102 by electrical power, cooling of the particular portion of the resistor layer 102 occurs by conducting heat through the substrate 101 and by dissipating the heat through the heatsink 105 to surrounding air. In other words, cooling time of the heating element of the resistor layer depends on natural cooling which in turn depends on such factors as the combination of the heat capacity of the resistor layer 102, heat capacity and conductivity of the substrate 101 and the heatsink 105 and an ambient temperature of the surrounding air. If, for example, the heat capacities of the resistor layer 102 and the substrate 101 are too large to dissipate the heat in time to follow the On/Off switching speed, problems such as trailing or a blur of a printing dot may occur. Even if the heat capacities of the resistor layer 102 and the substrate 101 are small, if the heatsink 105 cannot dissipate the heat conducted by the resistor layer 102 and the substrate 101 fast enough, the same problems may occur.

FIG. 2 shows a partial schematic plan view of an example of the resistor layer 102. A resistor portion 103 of the resistor layer 102 or a resistor element constitutes one heating element which is used to imprint a dot onto the thermosensitive paper. The resistor portion 103 has a rectangular shape. In order to imprint a dot, a pulse of electrical energy is supplied from the corresponding individual electrode 104 through the resistor portion 103 to the corresponding common electrode 105 and electrical current flows through the resistor portion 103 in the direction indicated by the arrow X in FIG. 2. This is the direction, a thermosensitive paper moves during printing. The direction indicated by the arrow Y in FIG. 2 shows the direction of a series of the resistor portions 103 of the resistor layer 2 being formed on the substrate 101. These directions indicated by X and Y in FIG. 2, hereinafter will be referred to as the paper moving direction and the resistor layer direction respectively. As the electrical current flows, the resistor portion 103 heats up to imprint a dark image of the dot onto the thermosensitive paper. Because both sides of the resistor portion 103 each facing a gap formed by each neighboring resistor portion can dissipate heat faster than the middle area of the resistor portion 103, the temperature buildup of the middle area occurs faster than the sides of the resistor portion 103.

FIG. 3 shows a typical temperature profile of the resistor portion 103 when the resistor portion 103 is heated. The horizontal axis indicates the temperature and the vertical axis shows position within the resistor portion 103 in the resistor layer direction. As the thermosensitive paper moves above the resistor portion 103 in the paper moving direction, the middle area of the resistor portion 103 where the temperature is highest, will imprint a darker image than other parts of the resistor portion 103.

FIG. 4 shows an example of the imprinted image of a dot by the resistor portion 103 in such a situation. The trailing edge of the imprinted image shows trailing or a blur because the middle area of the resistor portion 103 will take more time to cool down after the supply of the electrical energy is stopped, due to the temperature profile as shown in FIG. 3. This trailing or a blur causes deterioration of the printing quality. Conventionally, one way to prevent the blur was to slow down the printing speed enough allowing the middle area of the resistor portion 103 enough time to cool down in line with the other areas of the resistor portion 103 such that any blur becomes negligible.

SUMMARY OF THE INVENTION

In light of the above and in view of a general trend for faster printing, there exists a need for a thermal printhead capable of a faster printing rate while maintaining clean and high resolution printed images that can be used in such areas as portable/mobile, retail, gaming/lottery, and medical, including such devices as mobile device with a printer, POS, FAX, ATM, and the like.

Accordingly, the present invention is directed to a thermal printhead that fulfills this need.

An object of the present invention is to provide a thermal printhead having an optimally shaped resistor layer that is capable of producing high printing quality without sacrificing the printing speed.

Additional features and advantages of the invention will be set forth in the descriptions that follow and in part will be apparent from the description, or may be learned by practice of the invention. The objectives and other advantages of the invention will be realized and attained by the structure particularly printed out in the written description and claims thereof as well as the appended drawings.

To achieve these and other advantages and in accordance with the purpose of the present invention, as embodied and broadly described, the present invention provides a thermal printhead for progressively printing a pattern of dots on a thermosensitive paper moving in one direction, includes a substrate, and a plurality of resister elements on the substrate arranged in a substantially straight line extending in a direction perpendicular to a moving direction of the thermosensitive paper, the plurality of resister elements each corresponding to respective one of the dots constituting the pattern to be printed onto the thermosensitive paper, each of the resister elements having a heat transfer area that will be in contact with the thermosensitive paper upon printing the dot, wherein at least one of two sides of the heat transfer area that are substantially perpendicular to the moving direction of the thermosensitive paper has a sag in a substantially middle portion thereof to adjust a shape of the dot.

Many benefits are achieved by way of the present invention over conventional techniques. Certain embodiments of the present invention provides a thermal printhead capable of printing at a rate of faster than 1300 mm/sec without deterioration of the printing quality due to such factors as trailing, blur, fade, smear or the like that are more common with conventional thermal printheads having a printing speed of up to 300 mm/sec.

It is to be understood that both the foregoing general description and the following detailed description are exemplary and explanatory, and are intended to provide further explanation of the invention as claimed.

DETAILED DESCRIPTION OF THE PREFERRED EMBODIMENTS

Embodiments of the present invention provides a thermal printhead with an optimally shaped resistor layer. The thermal printhead includes a substrate, a plurality of individual and common electrodes, and a resistor layer. The resistor layer is formed on a substrate of the thermal printhead. During a series of printing images that requires a certain portion of the resistor layer to be heated repeatedly or with a high frequency by supplying electrical power, a temperature buildup of this particular portion of the resistor layer may become very large.

How fast the thermal printhead can print images without deterioration of the printing quality is in part determined by the rate of cooling the resistor layer. This rate depends mostly on the combination of a heat capacity and heat conductivities of the substrate and the resistor layer formed thereon, and the rate of heat dissipation of the rest of the thermal printhead to the surrounding air. Another factor that affects the quality and speed of printing involves physical shape of a resistor portion of the resistor layer or a resistor element which constitutes a heating element for imprinting a dot. Accordingly, in embodiments of the present invention, a thermal printhead is provided with an optimally shaped resistor portion which alleviates the deterioration of the printing quality and speed due to trailing or a blur caused by the temperature buildup of the resistor portion of the resistor layer. The optimally shaped resistor portion has sag on a side facing away from the paper moving direction. This sag effectively reduces the length of the middle area of the resistor portion in the paper moving direction in such a way that a blur is much less likely to occur when a dot is imprinted. This is explained in more detail below.

Figure 5:
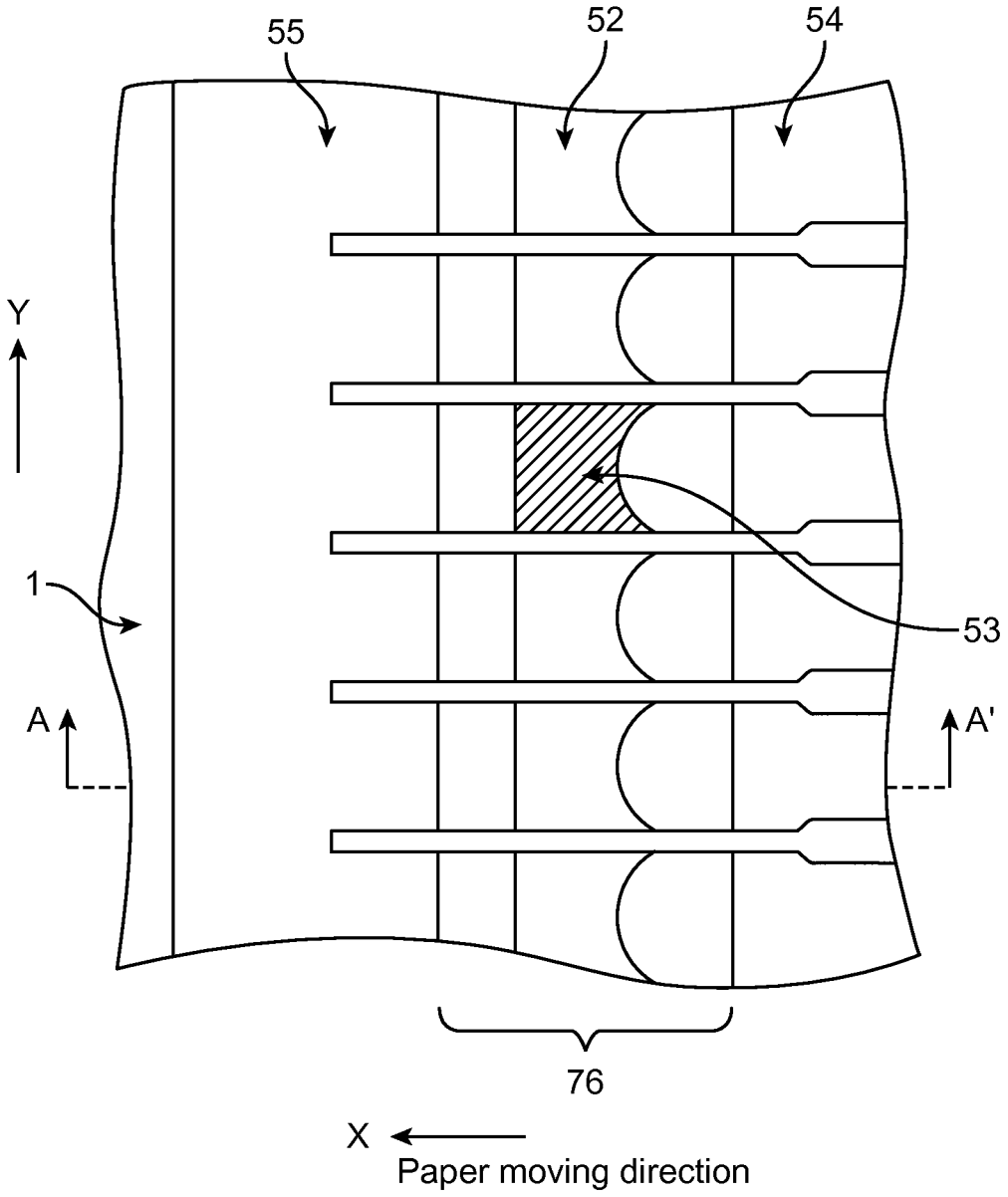
FIG. 5 is a partial schematic plan view of a thermal printhead according to a first embodiment of the present invention.

FIG. 5 illustrates a partial schematic plan view of a thermal printhead according to a first embodiment of the present invention. The thermal printhead includes a substrate 1, a resistor layer 52, a plurality of individual electrodes 54, and a plurality of common electrodes 55. The resistor layer 52 is divided into a plurality of resistor portions 53. As shown in FIG. 5, each of the resistor portions 53 is electrically and physically separated from each other. One side of the resistor portion 53 facing away from the paper moving direction has sag in the middle area which effectively reduces the length of the resistor portion 53 in the paper moving direction. The side of the resistor portion 53 where this sag is located corresponds to a trailing side with respect to the direction of imprinting a dot. Thus, even when this middle area of the resistor portion 53 has a higher temperature than other areas, printing in this area ends before the other areas because of the sag. This way, a blur is effectively prevented during imprinting of a dot. In FIG. 5, shape of this sag is shown as a half circle. However, this shape is merely an example that should not limit the scope of the claims.

Figure 6:
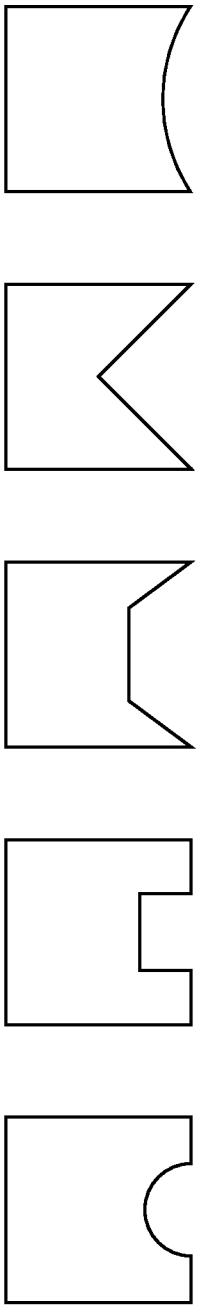
FIG. 6 shows variations of a resistor portion according to the first embodiment of the present invention.

FIG. 6 shows examples of alternate shapes for the sag. In addition to the half circle, triangle, trapezoidal, rectangular, and the like can be used depending on such factors as materials of the resistor layer 52, applications and environments for printing, and manufacturability of devices, among other factors.

In certain embodiments of the present invention, the heat capacity of the substrate 1 and the resistor layer 52 formed thereon is minimized by forming a thin resistive film on the substrate 1 to form the resistor layer 52.

Figure 7:
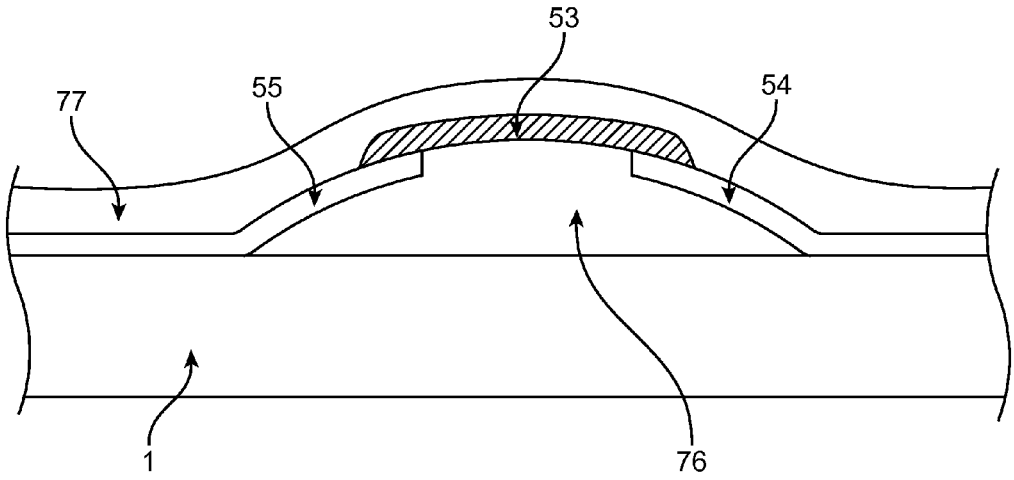
FIG. 7 is a schematic cross sectional view of the thermal printhead according to the first embodiment of the present invention.

FIG. 7 is a schematic cross sectional view of the thermal printhead of FIG. 5, taken along the line A-A'. The substrate 1 is made of ceramic, resin, metal, glass or the like. On the substrate 1, a glaze 76 having a curved upper surface bulged upward and extending in the resistor layer direction is formed. The common electrode 55 is formed on the substrate 1 and a front end of the common electrode 55 is formed on one side of the glaze 76. The individual electrode 54 is formed on the substrate 1 and a front end of the individual electrode 54 is formed on the other side the glaze 76 as shown in FIG. 7. The resistor portion 53 partially covering the common electrode 55 and the individual electrode 54 is formed extending in the same direction as the glaze 76. As better shown in FIG. 5, each of the plurality of individual electrodes 54 and corresponding one of the common electrodes 55 are arranged facing each other and connected by corresponding one of the resistor portions 53. The side facing away from the paper moving direction has sag in the middle area of the resistor portion 53. The common electrodes 55 are electrically connected with each other, while each of the individual electrodes 54 is connected to its respective drive IC. The drive IC supplies electrical energy selectively to the individual electrode 54 which in turn cause the respective resistor portion 53 to heat up, whereby printing is performed.

In certain embodiments, the resistor portions 53 of the resistor layer 52 can be formed as follows. By sputtering a resistive material on the substrate 1, a thin resistive film is formed. Using such a sputtering method, a thin resistive film with a thickness of 0.05 to 0.2 μm can be formed. Other methods such as chemical vapor deposition (CVD) and the like can also be used to form a thin resistive film. After the thin resistive film is formed on the substrate 1, a photolithographic process can be used to form the resistor layer 52 having the resistor portion 53 with sag in the middle area.

In certain other embodiments, the resistor layer 52 can be formed as a thicker resistor layer by screen printing an elongated resistor strip on the substrate 1. After the elongated resistor strip is formed on the substrate 1, a photolithographic process can be used to form the resistor layer 52 having the resistor portion 53 with sag in the middle area. From the perspective of a heat capacity of the resistor layer 52, a thinner resistive film may be advantageous in obtaining a smaller heat capacity of the resistor layer 52 which allows a faster rate of heating/cooling of the resistor layer 52.

Figure 1:
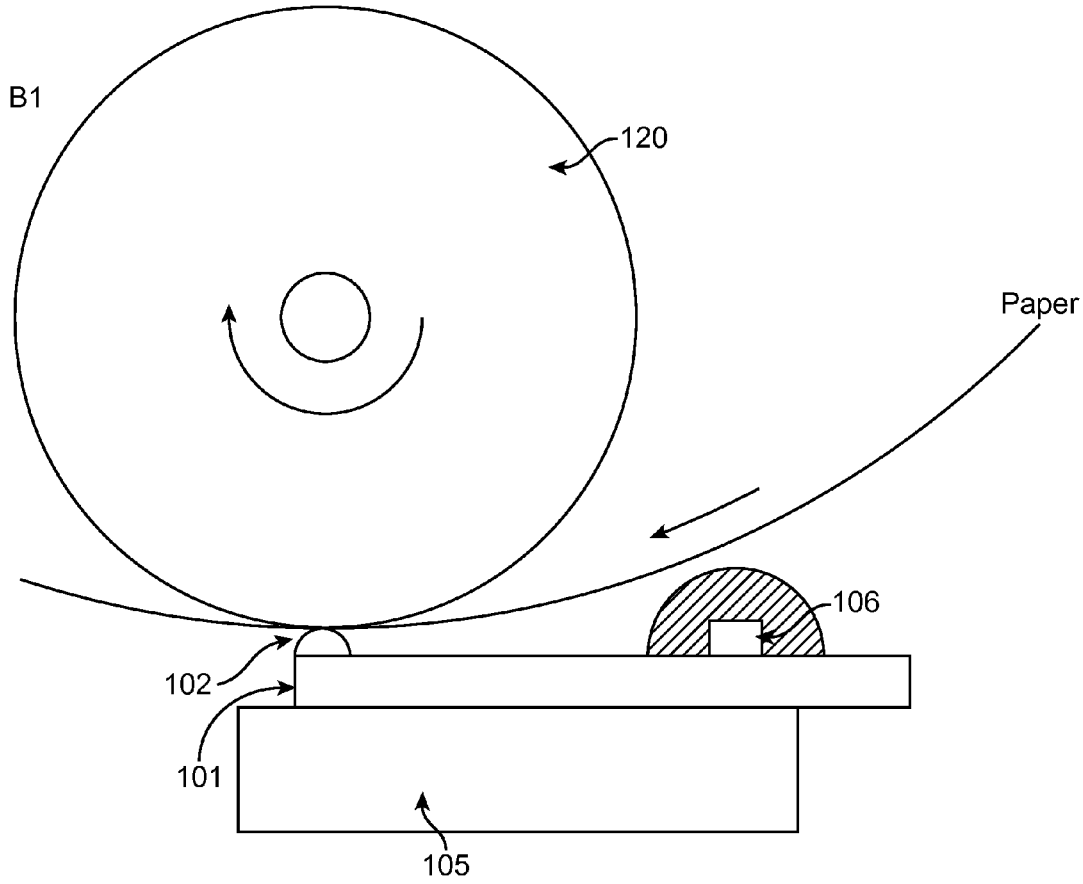
FIG. 1 is a schematic cross sectional view of a conventional thermal printer.
Figure 2:
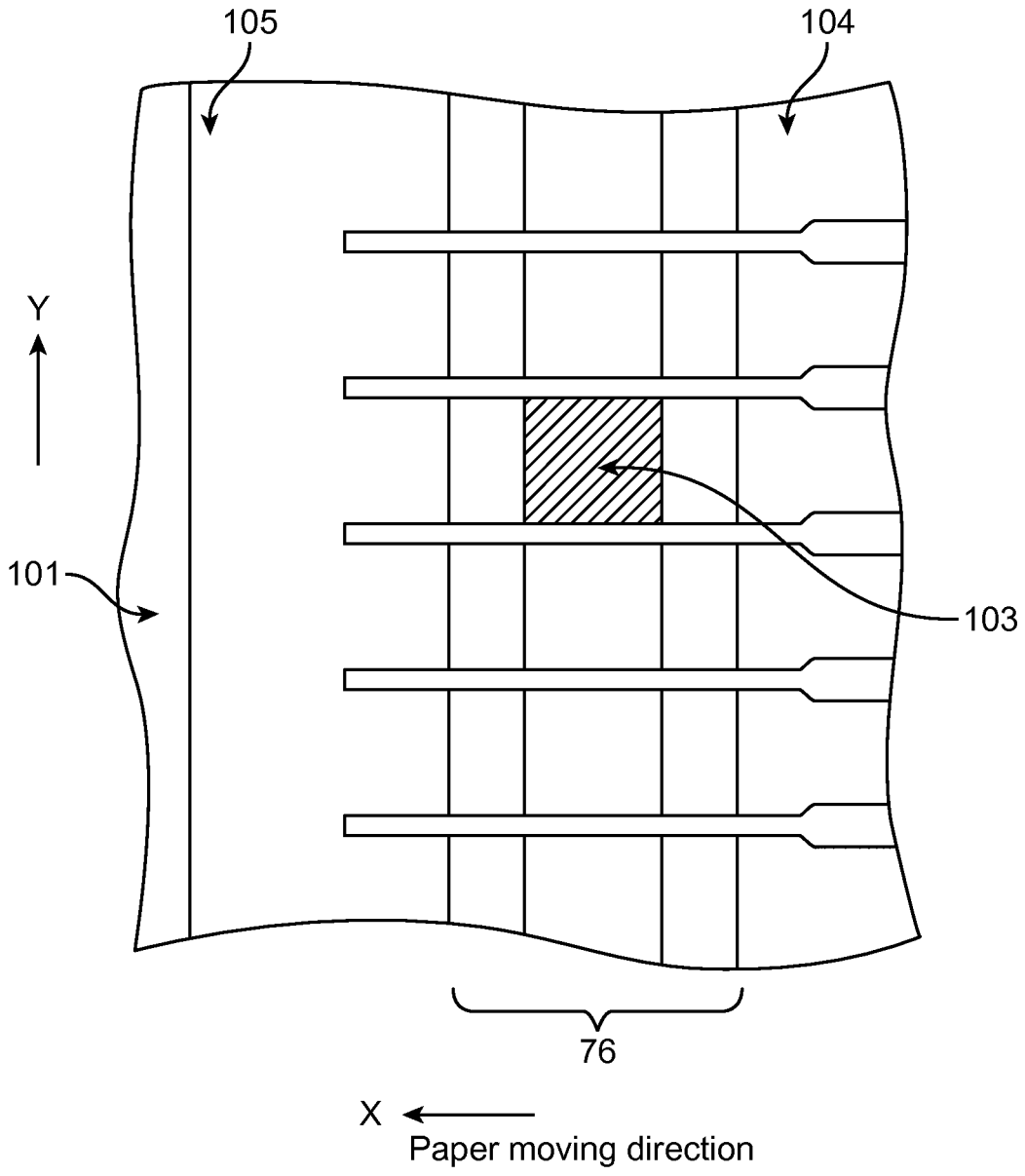
FIG. 2 is a partial schematic plan view of a conventional thermal printhead
Figure 3:
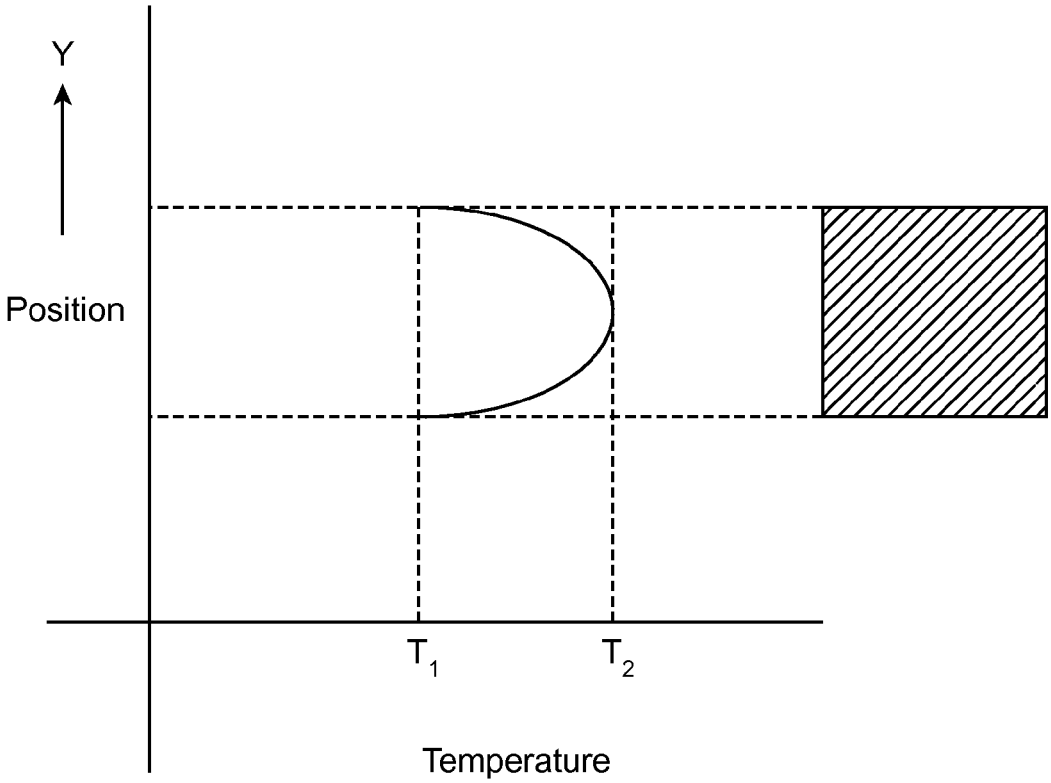
FIG. 3 shows a temperature profile of a resistor portion in a conventional thermal printhead.
Figure 4:
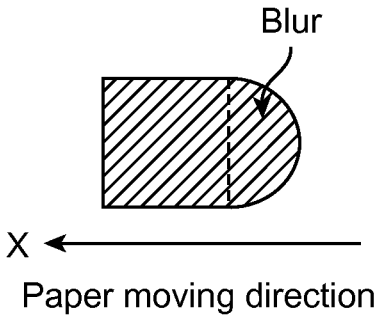
FIG. 4 shows an example of a printed image of a dot by a conventional thermal printhead.
Figure 8:
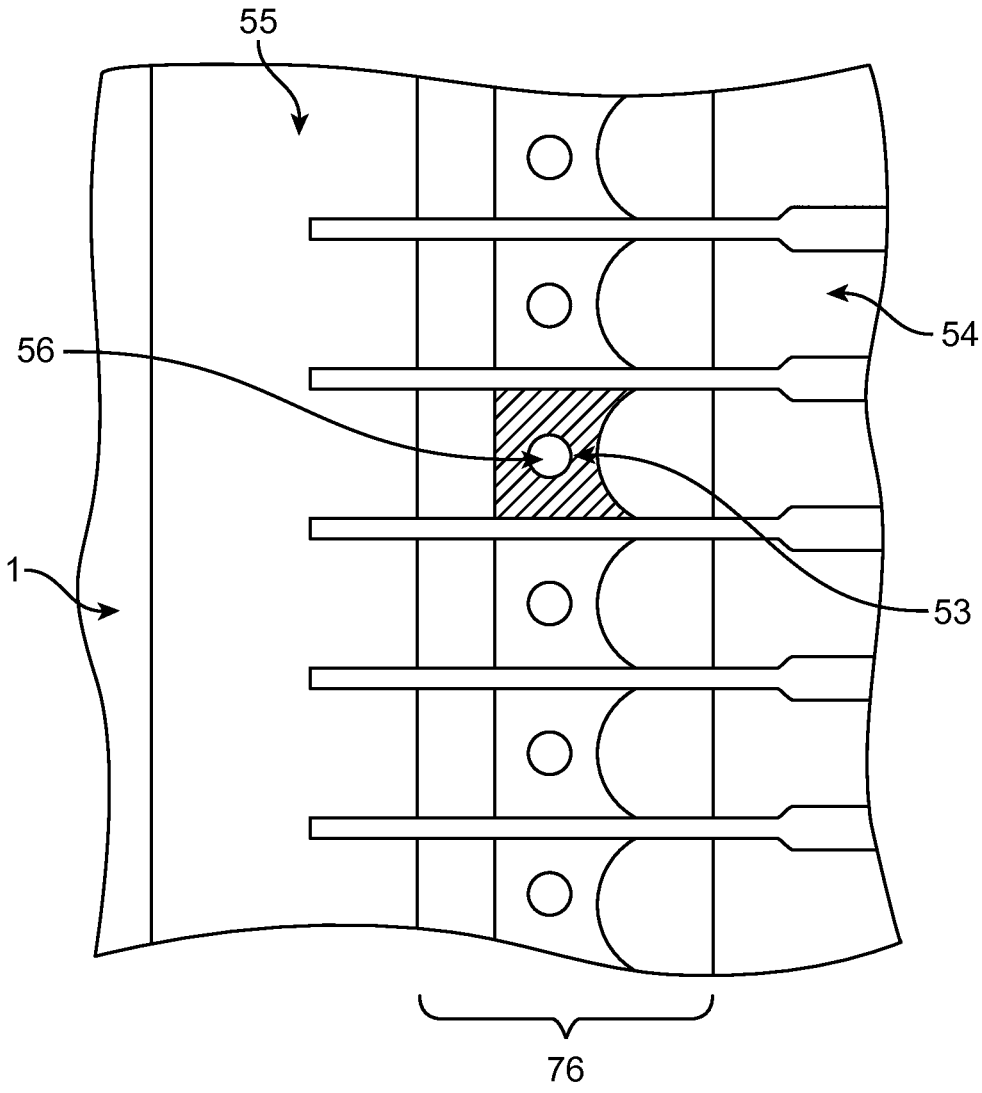
FIG. 8 is a partial schematic plan view of a variation of the thermal printhead according to the first embodiment of the present invention.

FIG. 8 shows a partial schematic plan view of a variation of the thermal printhead of FIG. 5. The resistor portion 53 shown in FIG. 8 has an opening 56 inside. The same photolithographic process to form the resistor portion 53 of the resistor layer 52 can be used to form this opening 56. The opening 56 has an effect of flattening the temperature profile of the resistor portion 53 such as the one shown in FIG. 3. By positioning the opening 56 in the area where the highest temperature would be reached without the opening 56, the temperature profile would become more flattened because the highest temperature point is now without the resistive film to heat up. This will also contribute to improving the printing quality without slowing down the speed of printing. The shape of this opening 56 is merely an example and is not limited to a circle as shown in FIG. 8.

Figure 9:
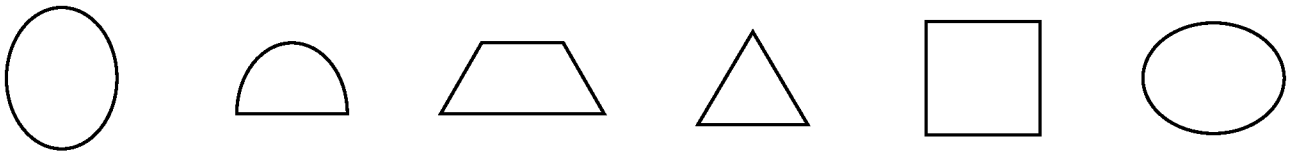
FIG. 9 shows examples of an opening according to the first embodiment of the present invention.

FIG. 9 shows examples of alternate shapes for the opening 56. In addition to the circle, triangle, trapezoidal, rectangular, elliptical, half circle and the like can be used for the opening 56 depending on such factors as materials of the resistor layer 52, applications and environments for printing, and manufacturability of devices, among other factors.

Figure 10:
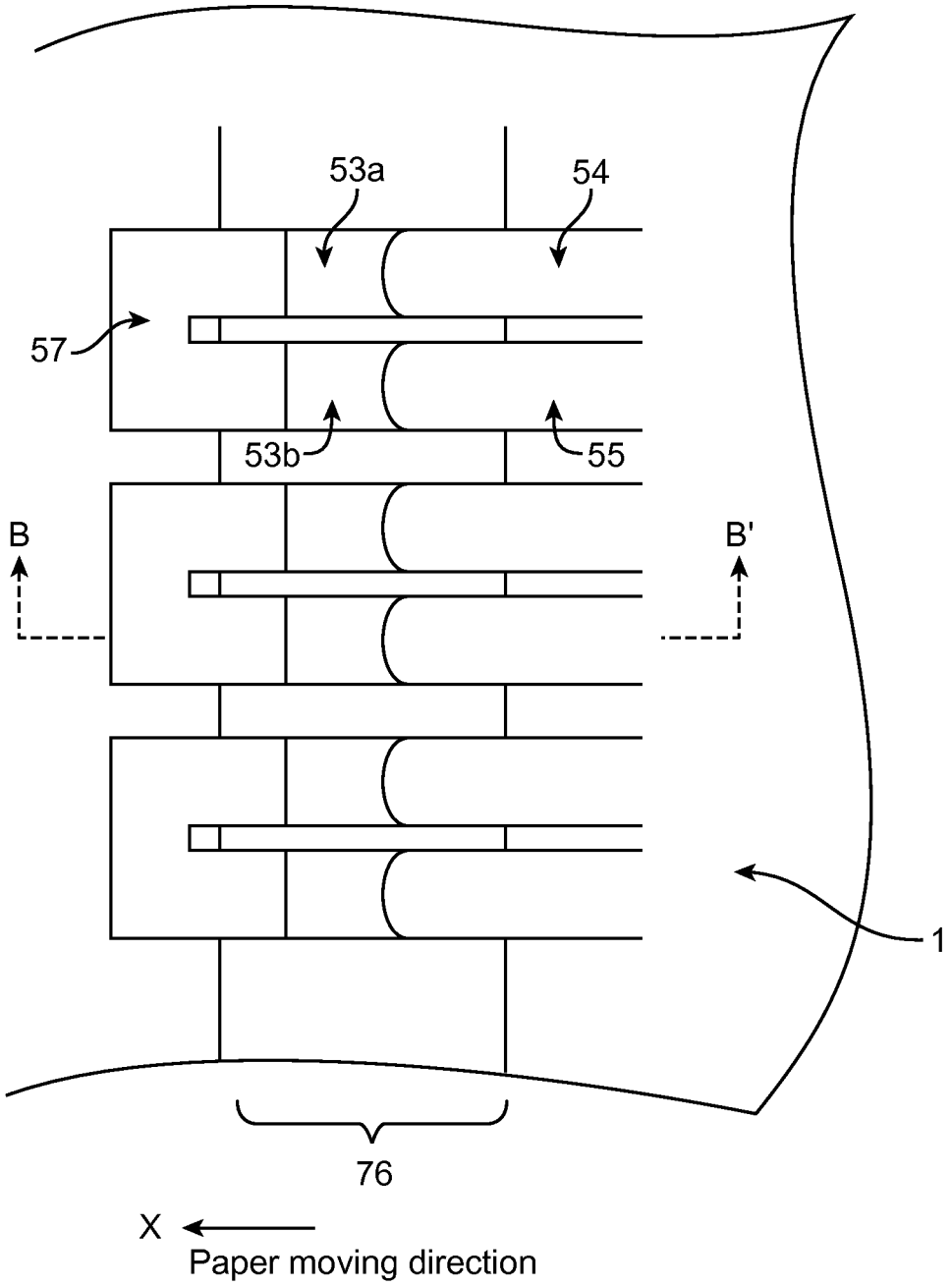
FIG. 10 is a partial schematic plan view of a thermal printhead according to a second embodiment of the present invention.
Figure 11:
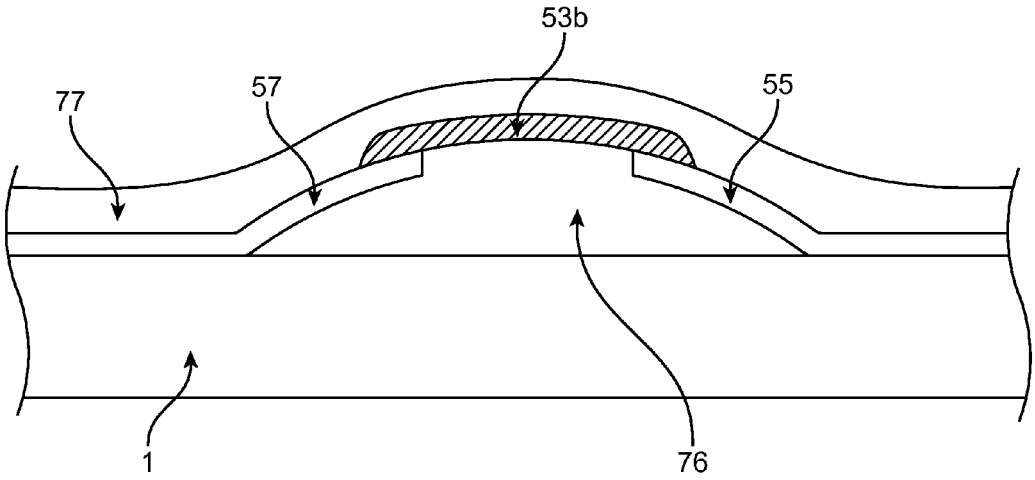
FIG. 11 is a partial schematic plan view of a thermal printhead according to the second embodiment of the present invention.

FIG. 10 shows a partial schematic plan view of a thermal printhead according to a second embodiment of the present invention. The second embodiment of a thermal printhead has a different topology from that of the first embodiment shown in FIG. 5, in that a set of first and second resistor portions 53*a*-53*b* constitutes a heating element to imprint a dot improving resolution of printing. FIG. 11 shows a schematic cross sectional view of the thermal printhead of FIG. 10, taken along the line B-B'. The thermal printhead includes a substrate 1, glaze 76, a plurality of individual electrodes 54, a plurality of common electrodes 55, a plurality of first and second resistor portions 53*a*-53*b*, a plurality of return electrodes 57 and a protective layer 77. The individual electrode 54 and the common electrode 55 are disposed alternately and side by side with each other. The substrate 1 is made of ceramic, resin, metal, glass or the like. On the substrate 1, a glaze 76 having a curved upper surface with a bulged portion under the first and second resistor portions 53*a*-53*b* and extending in the paper moving direction is formed. The common electrode 55 is formed on the substrate 1 and a front end of the common electrode 55 is formed on one side of the glaze 76. On the other side of the glaze 76, one end of the return electrode 57 is formed. The individual electrode 54 is formed side by side with the common electrode 55 and a front end of the individual electrode 54 is formed on the glaze 76 in a similar manner to the front end of the common electrode 55. One side of the second resistor portion 53*b* partially covers the front end of the common electrode 55 and the other side covers the front end of the return electrode 57. Similarly, one side of the first resistor portion 53*a* partially covers the front end of the individual electrode 54 and the other side covers the other front end of the return electrode 57.

As shown in FIG. 10, each of the first and second resistor portions 53*a*-53*b* are physically separated from each other. One side of the first resistor portion 53*a* is connected to corresponding one of the individual electrodes 54 and the other side is connected to one end of the return electrode 57. The other end of the return electrode 57 is connected to one side of corresponding one of the second resistor portions 53*b* and the other side of the corresponding one of the second resistor portions 53*b* is connected to the common electrode 55. The common electrodes 55 are electrically connected with each other, while each of the individual electrodes 54 is connected to its respective drive IC. The drive IC supplies electrical energy selectively to the individual electrode 54 which in turn causes the respective first and second resistor portions 53*a*-53*b* to heat up, whereby printing is performed.

The first and second resistor portions 53*a*-53*b* are disposed side by side with each other and connected to their respective individual and common electrodes 54-55. The first and second resistor portions 53*a*-53*b* can be disposed side by side alternately with each other, or they can be disposed in a manner such that two resistor portions of each kind are alternately disposed along with corresponding individual and common electrodes 54-55. One side of each of the first and second resistor portions 53*a*-53*b* facing away from the paper moving direction has sag in the middle area which effectively reduces the length of each of the first and second resistor portions 53*a*-53*b* in the paper moving direction. The side of each of the first and second resistor portions 53*a*-53*b* where this sag is located corresponds to a trailing side with respect to the direction of imprinting a dot. Thus, even when this middle area of each of the first and second resistor portions 53*a*-53*b* has a higher temperature than other areas, printing in this area ends before the other areas because of the sag. This way, a blur is effectively prevented during imprinting of a dot. In FIG. 10, shape of this sag is shown as a half circle. However, this shape is merely an example that should not limit the scope of the claims. In addition to the half circle, triangle, trapezoidal, rectangular, and the like can be used depending on such factors as materials of the first and second resistor portions 53*a*-53*b*, applications and environments for printing, and manufacturability of devices, among other factors.

FIG. 11 is a schematic cross sectional view of the thermal printhead of FIG. 10, taken along the line B-B'. The substrate 1 is made of ceramic, resin, metal, glass or the like. On the substrate 1, a glaze 76 having a curved upper surface bulged upward and extending in the resistor layer direction is formed. The second resistor portion 53*b* partially covering the common electrode 55 and the return electrode 57 is formed on the glaze 76. The first and second resistor portions 53*a*-53*b* can be formed substantially similar manner to the resistor layer 52 of the first embodiment of the present invention. By sputtering a resistive material on the substrate 1, a thin resistive film is formed. Using such a sputtering method, a thin resistive film with a thickness of 0.05 to 0.2 μm can be formed. Other methods such as chemical vapor deposition (CVD) and the like can also be used to form a thin resistive film. After the thin resistive film is formed on the substrate 1, a photolithographic process can be used to form each of the first and second resistor portions 53*a*-53*b* with sag in the middle area.

Figure 12:
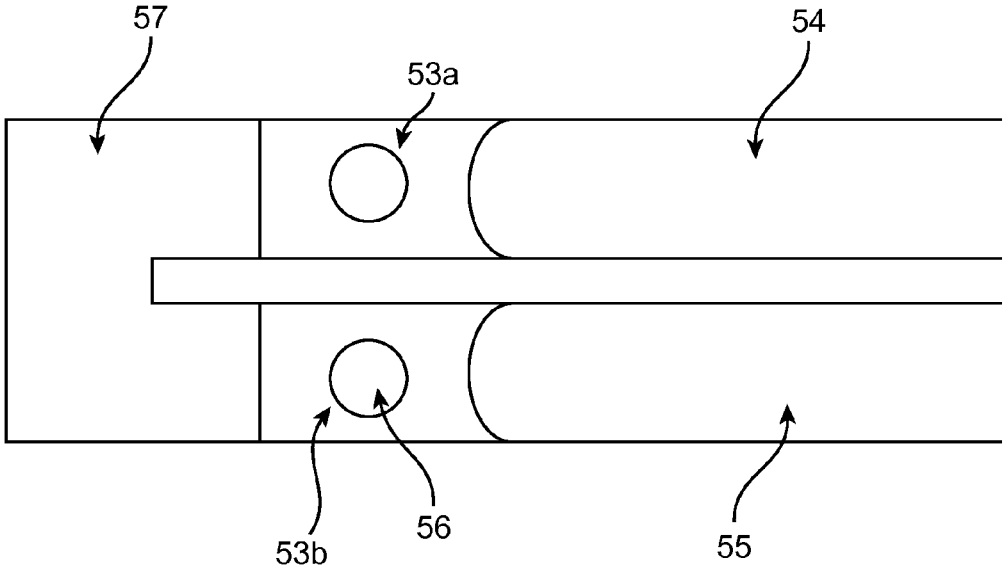
FIG. 12 shows examples of an opening in the thermal printhead of the second embodiment.

FIG. 12 shows a partial schematic plan view of a variation of the thermal printhead of the second embodiment. Each of the first and second resistor portions 53*a*-53*b* shown in FIG. 12 has an opening 56 inside. The same photolithographic process to form each of the first and second resistor portions 53*a*-53*b* can be used to form this opening 56. The opening 56 has an effect of flattening the temperature profile of each of the first and second resistor portions 53*a*-53*b*. By positioning the opening 56 in the area where the highest temperature would be reached without the opening 56, temperature profile will become more flattened because would be the highest temperature point is now without the resistive film to heat up. This will also contribute to improving the printing quality without slowing down the speed of printing. The shape of this opening 56 is not limited to an elongated circle as shown in FIG. 12. In addition to the elongated circle, triangle, trapezoidal, rectangular, elliptical, half circle and the like can be used for the opening 56 depending on such factors as materials of the resistor portions, applications and environments for printing, and manufacturability of devices, among other factors.

Figure 13:
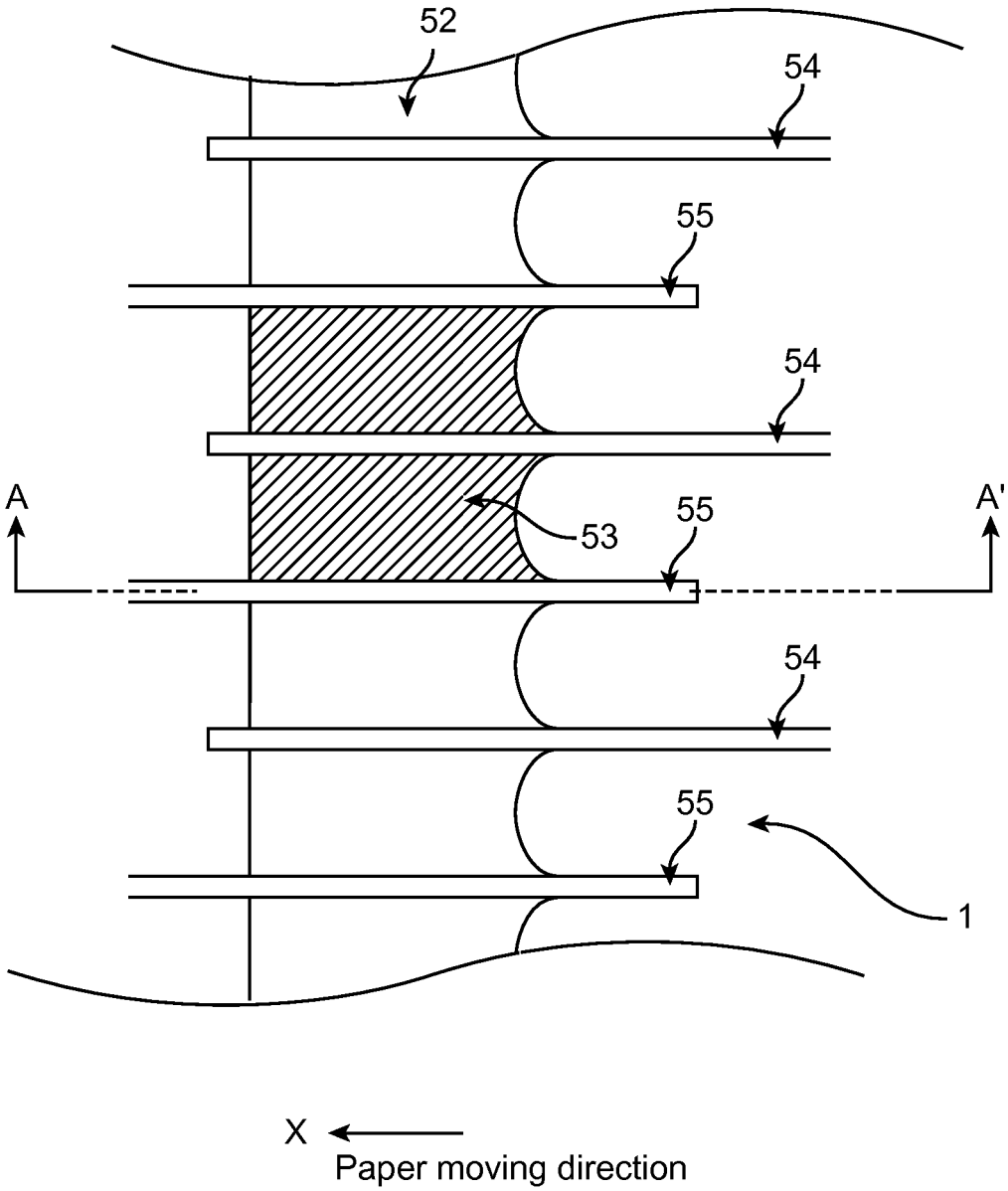
FIG. 13 is a schematic cross sectional view of the thermal printhead according to a third embodiment of the present invention.

FIG. 13 illustrates a partial schematic plan view of a thermal printhead according to a third embodiment of the present invention. The thermal printhead includes a substrate 1, a resistor layer 52, a plurality of individual electrodes 54, and a plurality of common electrodes 55. The resistor layer 52 is divided into a plurality of resistor portions 53. As shown in FIG. 13, each of the resistor portions 53 is electrically separated by corresponding one of the individual electrodes 54 and corresponding one of the common electrodes 55. One side of the resistor portion 53 facing away from the paper moving direction indicated by the arrow X has sag in the middle area which effectively reduces the length of the resistor portion 53 in the paper moving direction. The side of the resistor portion 53 where this sag is located corresponds to a trailing side with respect to the direction of imprinting a dot. Thus, even when this middle area of the resistor portion 53 has a higher temperature than other areas, printing in this area ends before the other areas because of the sag. This way, a blur is effectively prevented during imprinting of a dot. In FIG. 13, shape of this sag is shown as a half circle. However, this shape is merely an example that should not limit the scope of the claims.

Figure 14:
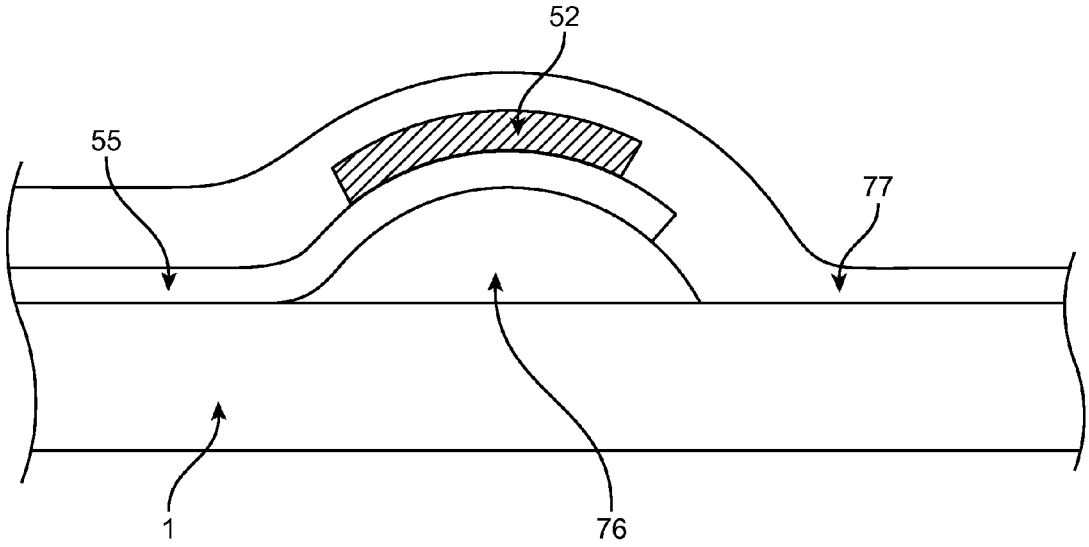
FIG. 14 is a schematic cross sectional view of the thermal printhead according to the third embodiment of the present invention.

FIG. 14 is a schematic cross sectional view of the thermal printhead of FIG. 13, taken along the line A-A'. The substrate 1 is made of ceramic, resin, metal, glass or the like. On the substrate 1, a glaze 76 having a curved upper surface bulged upward and extending in the resistor layer direction is formed. The common electrode 55 is formed on the substrate 1 and a front end of the common electrode 55 is formed on the glaze 76. The individual electrode 54 (not shown) is formed side by side with the common electrode 55 and a front end of the individual electrode 54 is also formed on the glaze 76. The resistor layer 52 partially covering the common electrode 55 and the individual electrode 54 is formed extending in the same direction as the glaze 76. As better shown in FIG. 13, each of the plurality of individual electrodes 54 and corresponding one of the common electrodes 55 are alternately arranged to form the resistor portion 53. The side facing away from the paper moving direction shown by the arrow X has sag in the middle area of the resistor portion 53. The common electrodes 55 are electrically connected with each other, while each of the individual electrodes 54 is connected to its respective drive IC. The drive IC supplies electrical energy selectively to the individual electrode 54 which in turn cause the respective resistor portion 53 to heat up, whereby printing is performed.

In the above embodiment, the resistor layer 52 can be formed in a substantially similar manner to the first and second embodiments. By sputtering a resistive material on the substrate 1, a thin resistive film is formed. Using such a sputtering method, a thin resistive film with a thickness of 0.05 to 0.2 μm can be formed. Other methods such as chemical vapor deposition (CVD) and the like can also be used to form a thin resistive film. After the thin resistive film is formed on the substrate 1, a photolithographic process can be used to form an elongate strip of the resistor layer 52 having the resistor portion 53 with sag in the middle area.

It will be apparent to those skilled in the art that various modification and variations can be made in the thermal printhead of the present invention without departing from the spirit or scope of the invention. Thus, it is intended that the present invention cover modifications and variations that come within the scope of the appended claims and their equivalents.

What is claimed is:

1. A thermal printhead for progressively printing a pattern of dots on a thermosensitive paper moving in one direction, comprising:

a substrate; and a plurality of resistor elements on the substrate arranged in a substantially straight line extending in a direction perpendicular to a moving direction of the thermosensitive paper, the plurality of resistor elements each corresponding to respective one of the dots constituting the pattern to be printed onto the thermosensitive paper, each of the resistor elements having at least one heat transfer area that will be in contact with the thermosensitive paper upon printing the dot, wherein the heat transfer area of each of the resistor elements is shaped to have a sag in a plan view in at least one of two boundary lines that define the heat transfer area along the moving direction of the thermosensitive paper, the sag being positioned in a substantially middle portion of a length of the boundary line, to adjust a shape to be printed onto the thermosensitive paper by the heat transfer area of the resistor elements.

2. The thermal printhead according to claim 1, wherein the sag is in a boundary line of the heat transfer area that faces away from the moving direction of the thermosensitive paper.

3. The thermal printhead according to claim 1, wherein the resistor element has an opening within the heat transfer area.

4. The thermal printhead according to claim 3, wherein the opening in the resistor element is in the shape of ellipse.

5. The thermal printhead according to claim 3, wherein the opening in the resistor element is in the shape of rectangular.

6. The thermal printhead according to claim 3, wherein the opening in the resistor element is in the shape of triangle.

7. The thermal printhead according to claim 3, wherein the opening in the resistor element is in the shape of trapezoid.

8. The thermal printhead according to claim 3, wherein the opening in the resistor element is in the shape of semi-ellipse.

9. The thermal printhead according to claim 1, wherein the sag is in a boundary line of the heat transfer area that faces away from the moving direction of the theromosensitive paper, and is in the shape of a concave curve extending throughout the side.

10. The thermal printhead according to claim 1, wherein the sag is in a boundary line of the heat transfer area that faces away from the moving direction of the theromosensitive paper, and is in the shape of a half-triangle.

11. The thermal printhead according to claim 1, wherein the sag is in a boundary line of the heat transfer area that faces away from the moving direction of the theromosensitive paper, and is in the shape of a half-hexagon.

12. The thermal printhead according to claim 1, wherein the sag is in a boundary line of the heat transfer area that faces away from the moving direction of the theromosensitive paper, and is in the shape of a half-rectangle.

13. The thermal printhead according to claim 1, wherein the sag is in a boundary line of the heat transfer area that faces away from the moving direction of the theromosensitive paper, and is in the shape of a semi-circle.

* * * * *